US006087989A

United States Patent [19]

Song et al.

[11] Patent Number: 6,087,989

[45] Date of Patent: Jul. 11, 2000

[54] CAVITY-BACKED MICROSTRIP DIPOLE ANTENNA ARRAY

[75] Inventors: Seong-chil Song, Yongin; Igor Timofeeve, Suwon, both of Rep. of Korea

[73] Assignee: SamSung Electronics Co., Ltd., Suwon, Rep. of Korea

[21] Appl. No.: 09/050,906

[22] Filed: Mar. 31, 1998

[30] Foreign Application Priority Data

Mar. 31, 1997 [KR] Rep. of Korea ..... 97-11829

[51] Int. Cl.[7] ..... H01Q 1/38

[52] U.S. Cl. ..... 343/700 MS; 343/803; 343/813

[58] Field of Search ..... 343/700, 727, 343/770, 793, 853, 797, 846, 746, 741, 751, 767, 794, 798, 801–4, 813, 815, 817–8, 820, 825, 827, 831, 833–4

[56] References Cited

U.S. PATENT DOCUMENTS

| | | | |
|---|---|---|---|
| 3,995,277 | 11/1976 | Olyphant, Jr. | 343/846 |
| 4,083,046 | 4/1978 | Kaloi | 343/700 MS |
| 4,287,518 | 9/1981 | Ellis, Jr. | 343/700 MS |
| 4,426,649 | 1/1984 | Dubost et al. | 343/700 MS |
| 4,527,165 | 7/1985 | De Ronde | 343/778 |
| 4,575,725 | 3/1986 | Tresselt | 343/700 MS |
| 4,719,470 | 1/1988 | Munson | 343/700 MS |
| 4,740,793 | 4/1988 | Wolfson et al. | 343/700 MS |
| 4,761,654 | 8/1988 | Zaghloul | 343/700 MS |
| 4,812,855 | 3/1989 | Coe et al. | 343/818 |
| 4,847,626 | 7/1989 | Kahler et al. | 343/700 MS |
| 4,922,263 | 5/1990 | Dubost et al. | 343/797 |
| 4,932,420 | 6/1990 | Goldstein | 128/804 |
| 5,241,321 | 8/1993 | Tsao | 343/700 MS |
| 5,268,701 | 12/1993 | Smith | 343/767 |
| 5,300,936 | 4/1994 | Izadian | 343/700 MS |
| 5,321,411 | 6/1994 | Tsukamoto et al. | 343/700 MS |
| 5,396,202 | 3/1995 | Scheck | 343/700 MS |
| 5,400,042 | 3/1995 | Tulintseff | 343/727 |
| 5,661,493 | 8/1997 | Uher et al. | 343/700 MS |
| 5,709,832 | 1/1998 | Hayes et al. | 264/272.11 |

FOREIGN PATENT DOCUMENTS

| | | |
|---|---|---|
| 0 044 779 | 7/1981 | France . |
| 0 089 084 | 3/1983 | France . |
| 0 044 779 | 1/1982 | Germany . |
| 0 089 084 | 9/1983 | Germany . |

*Primary Examiner*—Don Wong
*Assistant Examiner*—James Clinger
*Attorney, Agent, or Firm*—Robert E. Bushnell, Esq.

[57] ABSTRACT

A cavity-backed microstrip dipole antenna array is provided with a microstrip feeder network and a plurality of dipoles which are etched and formed on a single printed circuit board (PCB). Therefore, the structure is simple and inexpensive. Moreover, the antenna array can operate over a wider frequency bandwidth, and the thickness can be reduced to 0.1 of the wavelength of the transmitted/received signal.

26 Claims, 6 Drawing Sheets

CAVITY-BACKED MICROSTRIP DIPOLE ANTENNA ARRAY

CLAIM FOR PRIORITY

This application makes reference to, incorporates the same herein, and claims all benefits accruing under 35 U.S.C. §119 from an application for CAVITY-BACKED MICROSTRIP DIPOLE ANTENNA ARRAY earlier filed in the Korean Industrial Property Office on the 31st of Mar. 1997, and there duly assigned Ser. No. 11829/1997, a copy of which application is annexed hereto.

BACKGROUND OF THE INVENTION

1. Technical Field

The present invention relates to a cavity-backed microstrip dipole antenna array, and more particularly, to a low profile cavity-backed microstrip dipole antenna array capable of forming a precise beam and transmitting or receiving linearly polarized waves over a relatively wide bandwidth.

2. Related Art

Generally, microstrip or patch dipole antennas have been used for years as compact radiators of electromagnetic radiation. The antennas are designed in an array and may be used for communication systems such as identification of friend or foe (IFF) systems, personal communication service (PCS) systems, and satellite communication systems, which require characteristics of low cost, light weight, low profile, a precise form of beam and a low sidelobe.

A conventional microstrip patch antenna array having radiators and feeders which are etched on a single printed circuit board (PCB), such as disclosed in U.S. Pat. No. 3,995,277 for *Microstip Antenna* issued to Olyphant, Jr., U.S. Pat. No. 4,575,725 for *Double Tuned, Coupled Microstrip Antenna* issued to Tresselt, and U.S. Pat. No. 4,740,793 for *Antenna Elements And Arrays* issued to Wolfson et al., is low cost, lightweight and low profile. However, the microstrip path antenna usually operates over a narrow frequency bandwidth of 1~5% of the center frequency.

An inverted patch antenna array of a strip-slot form, and a stacked patch antenna array, as disclosed, for example, in "*Broad Band Patch Antenna*" written by J. F. Zurcher and F. E. Gardiol, 1995, Artech House, U.S. Pat. No. 5,300,936 for *Multiple Band Antenna* issued to Izadian, U.S. Pat. No. 5,400,042 for *Dual Frequency, Dual Polarized Multi-Layered Microstrip Slot And Dipole Array Antenna* issued to Tulintseff, U.S. Pat. No. 5,661,493 for *Layered Dual Frequency Antenna Array* issued to Uher et al., operate over a broader frequency bandwidth of, for example, 15~20% of the center frequency. However, at least two or three printed circuit boards (PCB) are required, which attribute to the high cost and the thickness of the array. In addition, the mutual coupling prevents the array from synthesizing a precise radiating pattern, for example, a low sidelobe or cosecant beam synthesis, and from minimizing undesirable cross polarizations. The same problems are also found in planar antenna arrays having window radiators as disclosed, for example, in U.S. Pat. No. 4,761,654 for *Electromagnetically Coupled Microstrip Antennas Having Feeding Patches Capacitively Coupled To Feedlines* issued to Zaghloul, U.S. Pat. No. 4,922,263 for *Plate Antenna With Double Crossed Polarizations* issued to Dubost et al., and U.S. Pat. No. 5,321,411 for *Planar Antenna For Linearly Polarized Waves* issued to Tsukamoto et al.

A conventional radiator most appropriate for suppressing the mutual coupling, improving polarization properties, and reducing edge effect and back radiation, is known as a cavity-backed radiator, as disclosed, for example, in "*Microwave cavity antennas*" written by A. Kumar & H. D. Hristov, 1989, chapter 1, and IEEE Antenna and Propagation Magazine, v.38, No. 4, 1966, pp. 7–12. A typical cavity-backed microstrip dipole array requires formation of multiple-beam and control of sidelobe, and is widely used for complex communication systems such as communication satellites "Odyssey". However, in the conventional cavity-backed array, the cavity has a depth of 0.3~0.6 times wavelength of the transmitted/received signal, and is located under a feeder network, which increases the thickness of the array. In addition, advanced printed circuit technology, which employs microstrip dipoles having a wide bandwidth and a strip line feeder network, is used for the formation of the cavity-backed microstrip dipole antenna as disclosed, for example, in U.S. Pat. No. 4,287,518 *For Cavity-Backed, Micro-Strip Dipole Antenna array* issued to Ellis, Jr. The cavity of the cavity-backed microstrip dipole antenna also requires a depth of approximately 0.3 times wavelength of the transmitted/received signal. Accordingly, the antenna cannot be thin. Moreover, a plurality of printed circuit boards (PCBs) for dipoles and a feeder network are necessarily used, which increase the cost of the array. Further, orthogonal junctions between a stripline feeder network and striplines of the dipoles require soldering and complicated fabrication techniques, which also attribute to the higher cost of the antenna array.

SUMMARY OF THE INVENTION

Accordingly, it is therefore an object of the present invention to provide an improved microstrip dipole antenna array that is simple, low profile and inexpensive to manufacture for operation over a wide frequency bandwidth.

It is also an object to provide a microstrip dipole antenna array which is capable of forming a precise beam, and efficiently transmitting or receiving linearly polarized waves over a relatively wide frequency bandwidth.

These and other objects of the present invention can be achieved by a cavity-backed microstrip dipole antenna array for operation over a wide frequency bandwidth which includes a microstrip feeder formed on an upper substrate; a plurality of radiation units having radiators formed symmetrically at a predetermined interval on one side of the upper substrate, and dipole arms formed in the center of the radiators for guiding electromagnetic waves excited by the microstrip feeder; a ground strip formed on one side of the upper substrate between two of the radiators; slots each located between two radiators and formed on the lower side of the upper substrate for insulating the dipole arms from electromagnetic waves; connection means for connecting the ground strip, the microstrip feeder and the dipole arms; and a lower substrate comprising a plurality of cavities located to face the radiation units of the upper substrate, each cavity having an opening of a shape and a size similar to the radiation unit, to contact the bottom surface of the upper and interact with the dipole arms to block mutual coupling of the adjacent radiators, when the upper substrate is attached on the lower substrate.

The present invention is more specifically described in the following paragraphs by reference to the drawings attached only by way of example.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
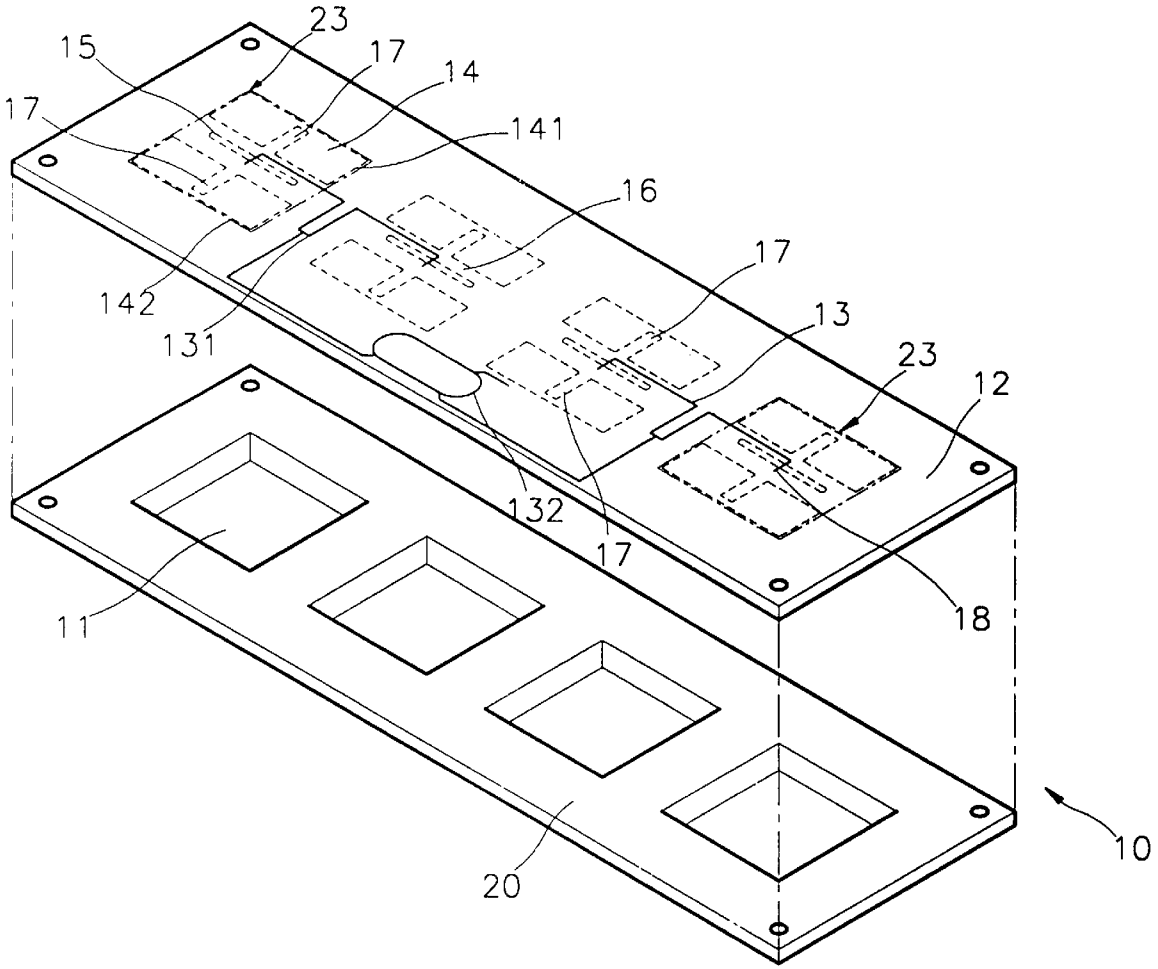
FIG. 1 is an exploded perspective view of a cavity-backed microstrip dipole antenna array constructed according to the principles of the present invention.

Referring now to the drawings and particularly to FIG. 1, which is an exploded perspective view of a cavity-backed microstrip dipole antenna array constructed according to the present invention. The antenna array 10 includes a lower substrate 20, formed of conductive material and having a plurality of rectangular or circular cavities 11 of a predetermined depth, and an upper substrate which is a printed circuit board (PCB) 12, obtained by printing polyphenol-oxide, teflon or fiberglass with conductive material such as copper, aluminum or silver. The cavities of the lower substrate 20 uniformly accommodate the lower surface of the PCB 12. A microstrip feeder 13 and radiators 141 and 142 are etched and formed on the PCB 12.

The two π-shaped radiators 141 and 142 are each formed by etching a conductor on the lower surface of the PCB 12 in the shape of a rectangle partially divided through the middle by a dipole arm 17. The microstrip feeder 13 is formed by etching the upper surface of the PCB 12, slots 15 for insulating both dipole arms 17 from microwaves are formed at the center between the radiators 141 and 142, and ground strips 16 are formed on the lower surface of the PCB 12 between the two radiators 141 and 142.

The lengths of the slot 15 and a pair of the dipoles arms 17 are a little shorter than half the wavelength of the transmitted/received signal, and they intersect orthogonally with each other in the center of the radiation unit 23. The dipole arms 17 are impedance matched to 50Ω feeder 13, by changing the lengths of the dipole arms 17 and slot 15. The microstrip feeder 13 including elementary dividers 131 and 132 such as Wilkensen type and a hybrid ring, may be formed of a corporate feeder, a serial feeder or other conventional array feeders.

Figure 2:
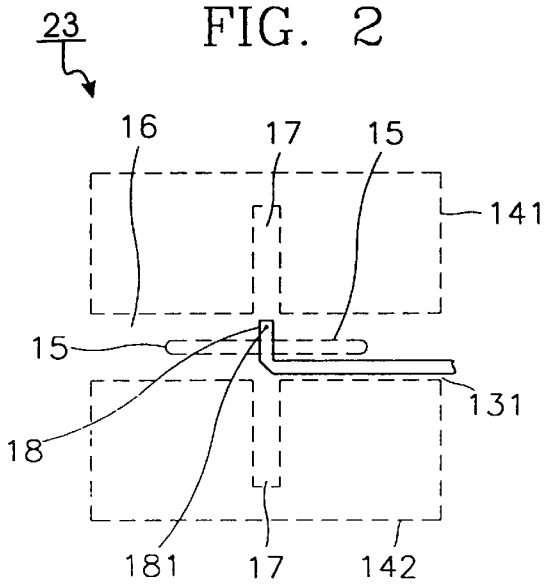
FIG. 2 illustrates a radiation unit of the cavity-backed microstrip dipole antenna array of FIG. 1.

FIG. 2 illustrates a preferred configuration of a radiation unit 23 of the dipole antenna array of FIG. 1. The radiation unit 23 is completed by extending a terminal 18 of the microstrip feeder 13 across the middle of the slot 15, and connecting the terminal 18 to the ground strip 16 by a connection hole 181. A microwave signal is transmitted through the unbalanced microstrip feeder 13 to the slots 15, the feeder terminal 18 and the connection hole 181, to be fed to the dipole arms 17.

The connection hole 181 connects a terminal 18 of the microstrip feeder 13 to the ground strip 16, which is a DC ground, in order to remove static electricity generated during operation of the dipole antenna 10. The open face of the cavity 11 of the lower substrate 20 contacts the PCB 12 such that a boundary of the radiators 141 and 142 coincides with the edge of the cavity 11. The cavities 11 of the lower surface of the dipole antenna array of FIG. 1 may be formed by stamping a metal plate of a material such as aluminum or copper alloy.

In a large-scale dipole antenna array, the cavities 11 are filled with a low-loss dielectric material to reduce the size of the radiators 141 and 142, thereby allowing more space for forming the feeder network. In addition, the cavities 11 may be formed of dielectric sheets. The sides of the cavity 11 are slightly longer than half the wavelength of the transmitted/received signal, and the depth thereof is 0.03 through 0.2 times of the transmitted/received wavelength. The cavity 11 interacts with the dipole arm 17, to block mutual coupling of the radiators 141 and 142, to suppress the surface wave radiation effects, and to symmetrically maintain right and left portions of the horizontal and vertical patterns of the transmitted wave which improves significantly the radiation pattern of the dipole ann 17.

Figure 3:
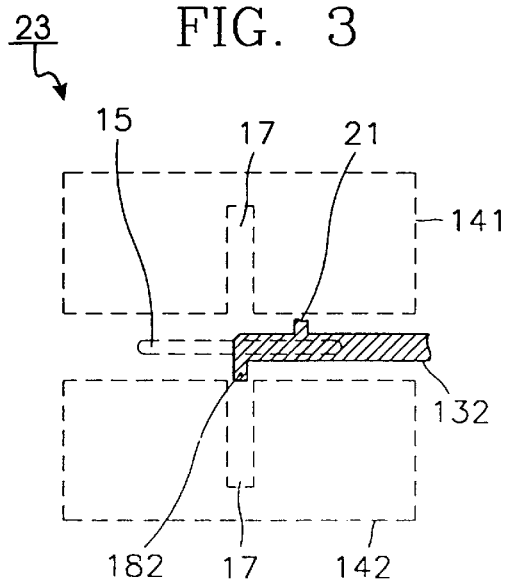
FIGS. 3 through 9 illustrate different embodiments of a radiation unit of the cavity-backed microstrip dipole antenna array of FIG. 1.

FIG. 3 illustrates another configuration of a radiation unit 23 of the dipole antenna array 10 of FIG. 1. As shown in FIG. 3, a microstrip feeder 13 is formed on the upper surface of the PCB 12, parallel to the slot 15, between the two adjacent radiators 141 and 142, and passes over the top of the slot 15 before extending to the connection hole 182. This configuration secures more regions for an impedance stub 21 used for controlling the inductance of the connection hole 182.

Figure 4:
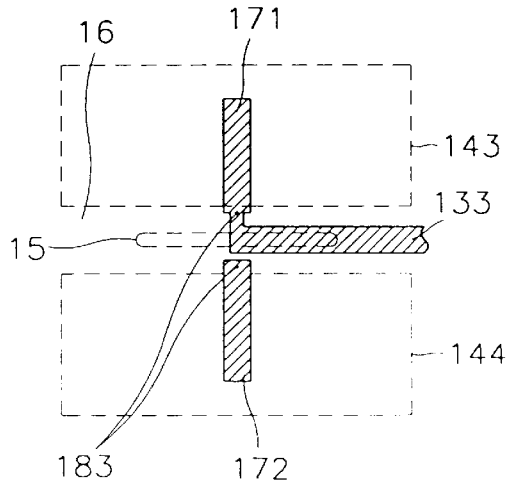

FIG. 4 illustrates yet another configuration of a radiation unit 23 of the dipole antenna array 10 of FIG. 1. As shown in FIG. 4, radiators 143 and 144 of the radiation unit 23 are etched on the lower surface of the PCB 12 in a rectangular form. The dipole arms 171 and 172 and the micro-strip feeder 133 are etched and formed on the upper surface of the PCB 12. The feeder network 133 coincides with the axis of the slot 15 and is connected to a ground strip 16 by two connection holes 183 located symmetrically about the slot 15. Accordingly, the electrical distance between the bottom of the cavity 11 and the dipole arms 171 and 172 increases by the thickness of the PCB 12 of FIG. 1, which, in turn, increases the frequency bandwidth of the antenna array.

Figure 5:
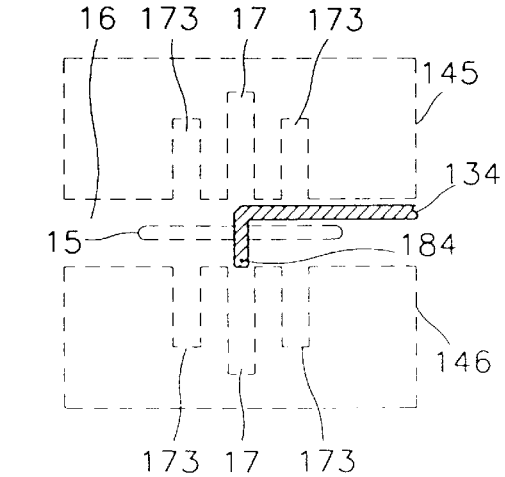

FIG. 5 illustrates still another configuration of a radiation unit 23 of the dipole antenna array 10 of FIG. 1. As shown in FIG. 5, radiators 145 and 146 of the radiation unit 23 are formed by etching the lower surface of the PCB 12 into a rectangular form partially divided by dipole arms 17 and also by parasitic elements 173 which are shorter than the dipole arms 17 and formed on both sides of each of the dipole arms 17. The microstrip feeder 134 is parallel to the slot 15 and formed on the upper surface of the PCB between the two radiators 145 and 146, and passes across the center of the slot 15 to extend to a connection hole 184. Due to the described parasitic elements, the capacitance of the dipole antenna array 10 assumes two or three resonant frequencies to enlarge the frequency bandwidth of operation.

Figure 6:
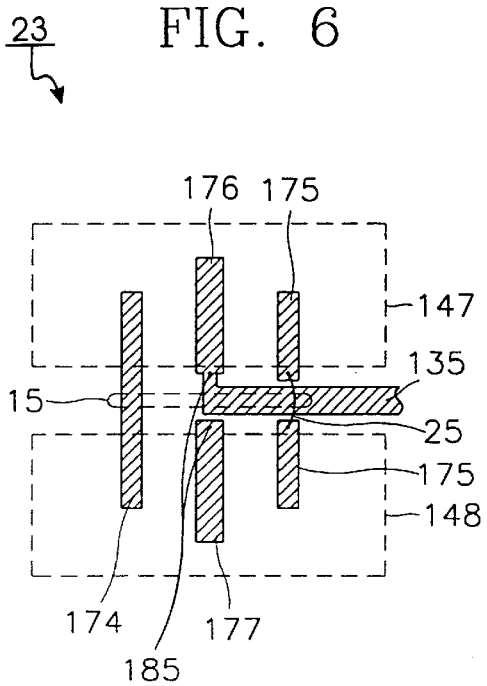

FIG. 6 illustrates another configuration of a radiation unit 23 of the dipole antenna array 10 of FIG. 1 using parasitic elements. As shown in FIG. 6, radiators 147 and 148 are etched in the lower surface of the PCB, in simple a rectangular form, and dipole arms 176 and 177 are formed on the upper surface of the PCB over the center of the radiators 147 and 148. First and second parasitic elements 174 and 175 have lengths different from the dipole arms 176 and 177, and are formed parallel to and on both sides of the dipole arms 176 and 177. The microstrip feeder 135 is formed on the upper surface of the PCB 12 parallel to the slot 15, between the two radiators 147 and 148, and passes over the top of the slot 15.

In this configuration, the first and second parasitic elements 174 and 175 arranged on the PCB 12 can be simply controlled. The second parasitic element 175 is divided in two by the microstrip feeder 135, and a strap 25 connects the two halves like abridge. The lengths of the dipole arms 176 and 177 are different from those of the first and second parasitic elements 174 and 175, causes two resonant operations, to thereby allow the radiation unit 23 of FIG. 6 to operate over a wider frequency bandwidth.

Figure 7:
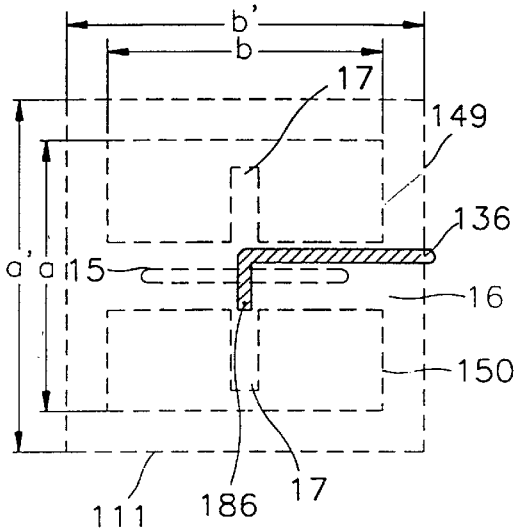

FIG. 7 illustrates yet still another configuration of a radiation unit 23 of the dipole antenna array 10 of FIG. 1. Referring to FIG. 7, radiators 149 and 150 are etched into the lower side of the PCB 12, in the same shape as in the configuration shown in FIG. 2, which is smaller than the outside edge 111 of the cavity, and the dipole arms 17 and the ground strip 16 are formed on the same plane.

The minimum area within the outside edge 111 of the cavity is set by $(\lambda/2)\epsilon^{1/2}$, where '$\epsilon$' indicates a dielectric constant, and '$\lambda$' indicates the wavelength of the transmitted/received signal. Also, the minimum values of the side lengths a and b of the radiators 149 and 150 may be predetermined as a value smaller by about 30% than lengths a' and b' of the sides of the cavity outside edge 111. In this configuration, a space capable of forming a sufficient microstrip feeder 136 network in a large scale two-dimensional array antenna is provided.

Figure 8:
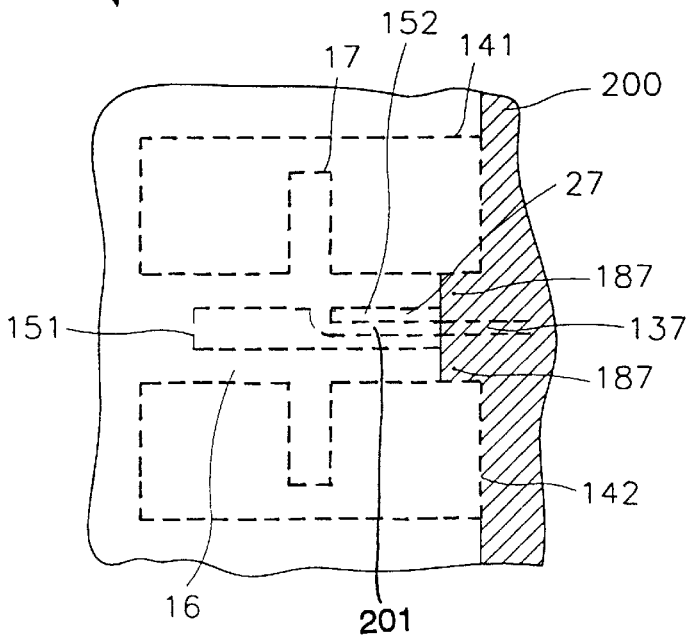

FIG. 8 illustrates yet another configuration of a radiation unit 23 of the dipole antenna array 10 of FIG. 1. Referring to FIG. 8, radiators 141 and 142 are etched into the lower surface of the PCB in the same shape as in FIG. 2, and dipole arms 17 and the ground strip 16 are formed on the same plane that of the radiators 141 and 142. A first slot 152 is formed to the right or left of the dipole arm 17 between the two radiators 141 and 142 and one half of a second slot 151 is parallel to the first slot 152 and the other half thereof, which the width of slot 152, coplanar strip line 201 and narrow part of slot 151, formed from the center of the dipole arm 17.

A coplanar strip feeder is formed between the first and second slots 152 and 151, parallel to the first and second slots 152 and 151, and is connected to one of the dipole arms 17 from the center of the dipole arm 17 a Microstrip line 137, located between the coplanar strip line 201 and the feeding network, not depicted herein. Hatched area which is on the upper surface of the PCB 12 is the ground plane 200 for the microstrip line 137 and the other microstrip line feeding network, not depicted herein. Connection holes 187 are located between the first slot 152 and the radiator 141, and between the second slot 151 and radiator 142, and the ground plane 200, upper surface of the PCB 12, therefore coplanar strip line 201 is realized.

In this configuration, the microstrip feeder 13, and all cavity circuits of the antenna array 10 of FIG. 1, are etched into the lower surface of the PCB 12, protected from exposure to the outside by the cavity 11. Accordingly, a radome which is a cover is not necessary, thereby lowering the weight and the product cost of the antenna array 10.

Figure 9:
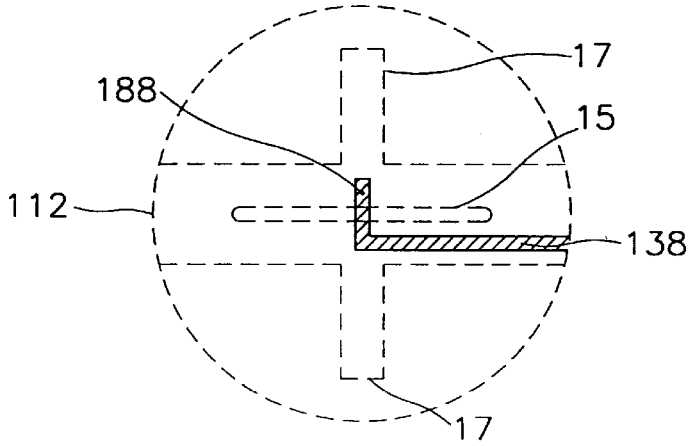

FIG. 9 shows part of the radiation unit 14 of still another embodiment of the dipole antenna array 10 of FIG. 1. Referring to FIG. 9, a contour 112 of a circular cavity may be more simply fabricated on the PCB 12 than the rectangular cavity 11.

Figure 10:
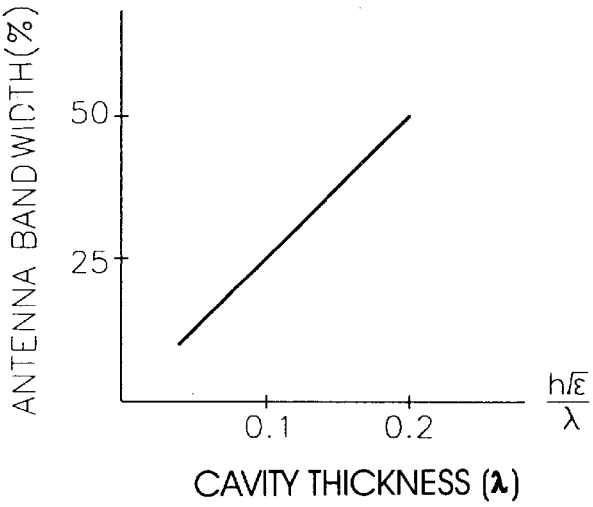
FIG. 10 is a graph illustrating the cavity thickness of the cavity-backed microstrip dipole antenna array as a function of the antenna bandwidth.

FIG. 10 is a graph showing the relationship between the thickness of the cavity in the antenna of FIG. 1 and the frequency bandwidth. Referring to FIG. 10, an antenna array 10 has a thickness of 0.005~0.2$\lambda$, and transmits or receives waves of a relatively wide frequency bandwidth of 10~40% of the center frequency. Here, 'h' indicates the depth of the cavity, '$\epsilon$' indicates the dielectric constant of the medium filling the cavity, and '$\lambda$' indicates the wavelength of the transmitted/received signal.

Figure 11:
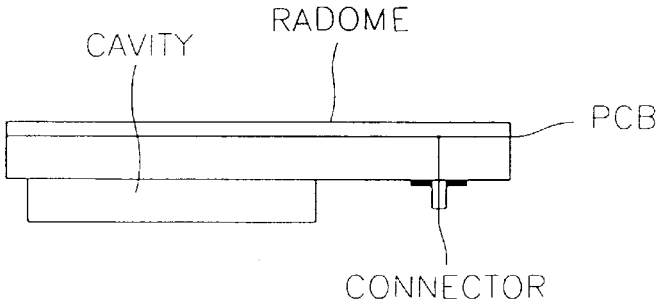
FIG. 11 is a side view of an IFF antenna employing the antenna array of FIG. 1.

FIG. 11 is a side view of an IFF (identification of friend or foe) antenna having a cavity depth of 0.1 wavelength of the transmitted/received signal, based on the antenna array of FIG. 1. That is, the antenna array of FIG. 1 is formed on a printed circuit board (PCB) with the usual cavity and connector formed on the lower surface of the PCB, and a radome, which is a cover, formed on the antenna array.

Figure 12A:
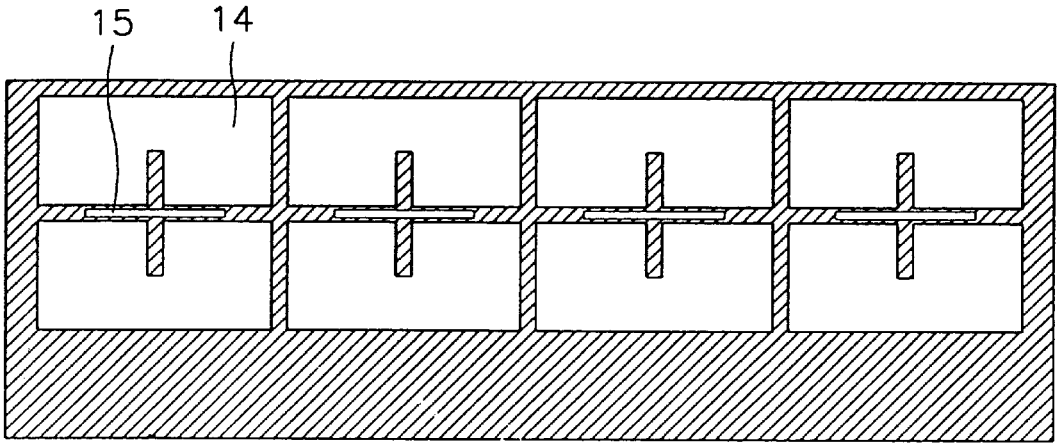
FIGS. 12A and 12B illustrate front and rear patterns of the IFF antenna of FIG. 11.
Figure 12B:
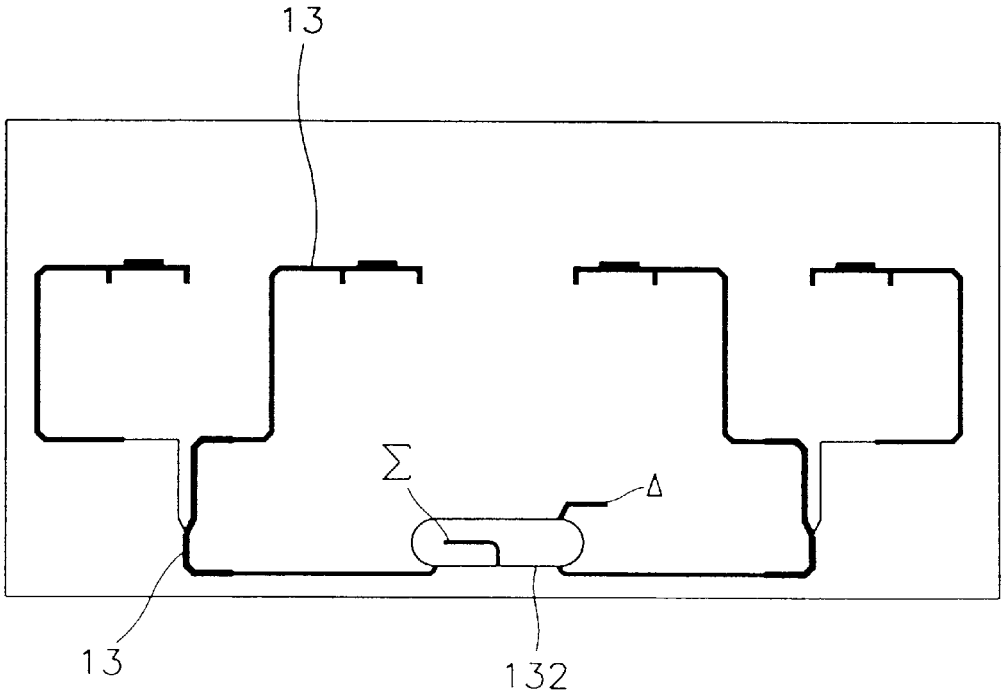

FIGS. 12A and 12B show front and rear patterns of the IFF antenna PCB of FIG. 11. Here, reference numerals 13, 14,15, and 132 indicate a feeder, a radiator, a slot, and elements of a divider, respectively.

Figure 13:
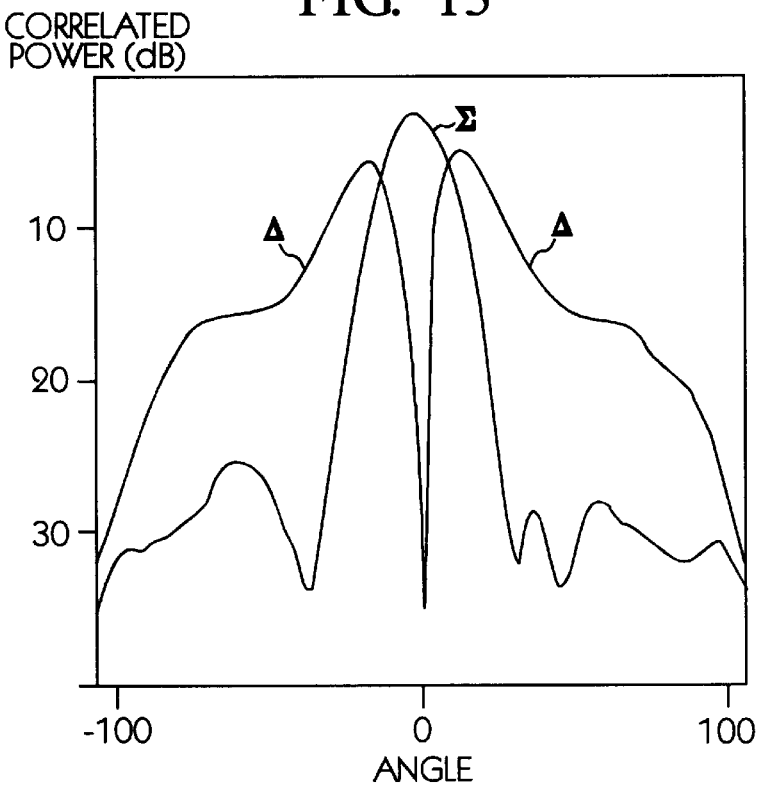
FIG. 13 illustrates measured values of correlated power with respect to a horizontal pattern of sum (Σ) and difference (Δ) beams of the IFF antenna of FIG. 11.

FIG. 13 shows measured values of correlated power with respect to a horizontal pattern of sum and difference beams of the IFF antenna of FIG. 11. A desirable pattern of interrogation side lobe suppression is shown.

Figure 14:
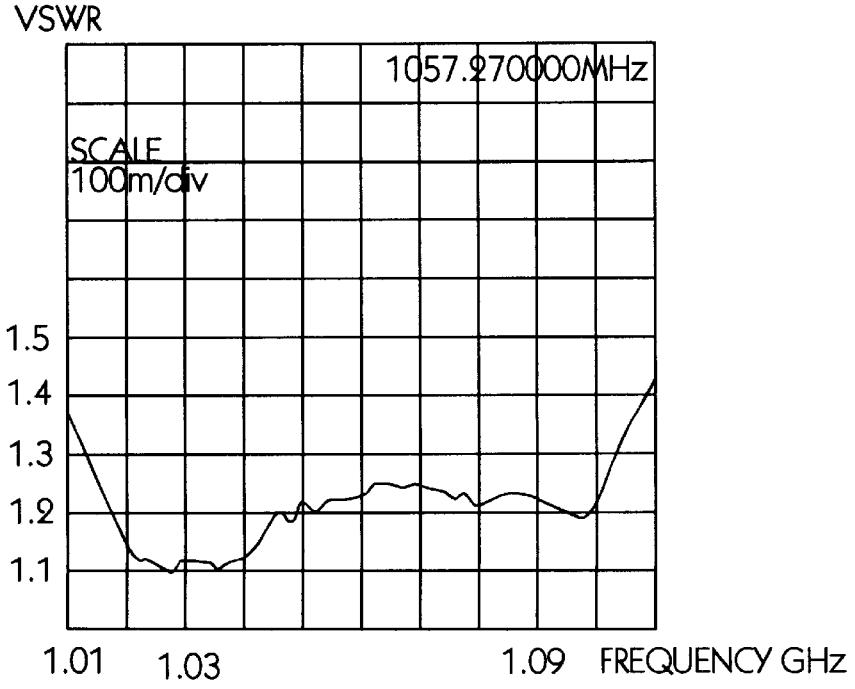
FIG. 14 is a graph illustrating voltage standing wave ratio (VSWR) measured at a sum signal input terminal of the IFF antenna of FIG. 11.

FIG. 14 is a graph showing voltage standing wave ratio (VSWR) measured at a sum signal input terminal of the IFF antenna of FIG. 11. Here, a low VSWR is shown.

While the antenna array produced by ERICSSON company, which is written in papers of 18th European Microwave Conference, Sep. 12–16th, 1988, in Stockholm, has 17 dB gain from twelve elements, the microstrip dipole antenna array constructed according to the principles to of the present invention has 14 dB gain from just four elements.

As described above, according to the microstrip dipole antenna array of the present invention, a microstrip feeder network and a plurality of dipoles are etched and formed on a single printed circuit board (PCB). As a result, the antenna array can be fabricated more simply and at low cost. In addition, the antenna array can be operated over a wider frequency bandwidth by using a cavity, and further fabricated with a thickness of 0.1 wavelength of the transmitted/received signal.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. A cavity-backed microstrip dipole antenna array, comprising:

a plurality of radiation units having radiators formed symmetrically at a predetermined interval on one side of said upper substrate, and dipole arms formed in the center of each of the radiators for guiding electromagnetic waves excited by the microstrip feeder, said plurality of radiation units including a first radiation unit having a first radiator and a second radiator, said first radiation unit further comprising:

a microstrip feeder formed on an upper substrate;

a ground strip formed on one side of said upper substrate between the first and second radiators;

a single linear slot located between and parallel to the first and second radiators and formed on one side of said upper substrate for insulating the dipole arms from electromagnetic waves, said slot being rectangular in shape;

connection means for connecting the ground strip, the microstrip feeder and the dipole arms;

a lower substrate comprising a cavity of a predetermined size, shape and depth, accommodating the first and second radiators, when said upper substrate is attached on said lower substrate, the slot and a pair of dipole arms having lengths slightly shorter than half a wavelength of a signal transmitted and slightly shorter than half a wavelength of a signal received, the slot and the pair of dipole arms intersecting orthogonally with each other in a center of each radiation unit, the pair of dipole arms having a narrow width.

2. The cavity-backed microstrip dipole antenna array of claim 1, wherein each one of said first and second radiators is formed by etching a bottom surface of said upper substrate with a rectangular shaped pattern partially divided by each dipole arm, the dipole arms and the ground strip are formed on the same plane, and the microstrip feeder is formed in parallel with the slot on a top surface of said upper substrate between the first and second radiators, passes over the slot, and extends to the connection means.

3. The cavity-backed microstrip dipole antenna array of claim 2, wherein the microstrip feeder has an impedance stub formed in a predetermined position for controlling an inductance of the connection means.

4. The cavity-backed microstrip dipole antenna array of claim 1, wherein each one of said first and second radiators is formed by etching a bottom surface of said upper substrate with a rectangular shaped pattern, the dipole arms are formed on a top surface of said upper substrate in the center of each radiator, and the microstrip feeder is formed on the top surface of said upper substrate parallel to the slot between the first and second radiators, passes over the slot and extends to the connection means.

5. The antenna array of claim 1, further comprising:

parasitic elements being formed adjacent to the dipole arms, said parasitic elements enlarging a frequency bandwidth of operation of said antenna array.

6. The cavity-backed microstrip dipole antenna array of claim 5, wherein each one of said first and second radiators is formed by etching a bottom surface of said upper substrate with a $\pi$-shaped pattern, the dipole arms are etched, the parasitic elements having a different length to the dipole arms are formed at the right and left of each dipole arm and are etched, the microstrip feeder being formed on a top surface of said upper substrate between the first and second radiators and parallel to the slot, the microstrip feeder passing over the slot and extending to the connection means.

7. The cavity-backed microstrip dipole antenna array of claim 5, wherein each one of said first and second radiators is formed by etching a bottom surface of said upper substrate with a rectangle shaped pattern, the dipole arms are formed on a top surface of said upper substrate in the center of each radiator, said parasitic elements including first and second parasitic elements having lengths different from those of the dipole arms and being formed at the right and left of each dipole arm, parallel to the dipole arm, and the microstrip feeder is formed on the top surface of said upper substrate between the first and second radiators, parallel to the slot, passes over the slot and extends to the connection means.

8. The cavity-backed microstrip dipole antenna array of claim 7, wherein the first parasitic element is formed as a single arm, and the second parasitic element is formed of two pieces divided by the microstrip feeder, and the two pieces of the second parasitic element are connected by a strap.

9. The cavity-backed microstrip dipole antenna array of claim 1, wherein each one of said first and second radiators is formed by etching a bottom surface of said upper substrate with a rectangular shaped pattern partially divided by a dipole arm, smaller than the edge of the opening of the cavity, the dipole arms and the ground strip are formed on a top surface of the same plane, and the microstrip feeder is formed on the top surface of said upper substrate between the two adjacent radiators, parallel to the slot, passes over the slot, and extends to the connection means.

10. The cavity-backed microstrip dipole antenna array of claim 1, wherein a minimum area of the cavity opening is set by $(\lambda/2)\epsilon^{1/2}$, where '$\alpha$' indicates a wavelength of a transmitted/received signal, and '$\epsilon$' indicates a dielectric constant, and minimum values of the side lengths of the radiators are about 30% smaller than the corresponding lengths of each side of the cavity opening.

11. The antenna array of claim 1, said slot further comprising a first slot section and a second slot section.

12. The cavity-backed microstrip dipole antenna array of claim 11, wherein each one of said first and second radiators is formed by etching a bottom surface of said upper substrate with a rectangular shaped pattern partially divided by a dipole arm, the dipole arm and the ground strip are formed on the same plane, the first slot section is formed at the right and left of each dipole arm between the first and second radiators and the second slot section is formed parallel to the first slot section, the feeder is formed on the plane where the first and second slot sections are formed, extending from the center point between two dipole arms, parallel to the first and second slot sections, to connect to one of the dipole arms and the connection means is located between the first slot section and the radiator, and between the second slot section and the opposing radiator, to electrically connect the ground plane of the surface and the ground strip of the bottom surfaces of said upper substrate.

13. The cavity-backed microstrip dipole antenna array of claim 1, wherein each one of said first and second radiators is formed such that an outer edge of said first radiation unit is a circle, the dipole arm is formed protruding into the radiator by a predetermined length, the dipole arm and the ground strip are formed on the same plane, the microstrip feeder is formed on a top surface of said upper substrate between the first and second radiators, parallel to the slot, passes over the slot and extends to the connection means.

14. An antenna array, comprising:

an upper substrate having a top surface and a bottom surface;

at least one microstrip feeder formed on the top surface of said upper substrate;

at least one radiation unit having adjacent radiators formed symmetrically at a predetermined interval on the bottom surface of said upper substrate, and dipole arms respectively formed in the center of adjacent radiators for guiding electromagnetic waves excited by the microstrip feeder;

a ground strip formed on the bottom surface of said upper substrate between the adjacent radiators;

a single linear slot formed on the bottom surface of said upper substrate and located between and parallel to the adjacent radiators for insulating the dipole arms from the electromagnetic waves, said slot being rectangular in shape;

connection means for providing electrical connection between the ground strip, the microstrip feeder and the dipole arms; and a lower substrate comprising at least one cavity of a predetermined size, shape and depth for fitting said radiation unit and interacting with the dipole arms to block mutual coupling of the adjacent radiators, when said upper substrate is attached on said lower substrate, the slot and a pair of dipole arms having lengths slightly shorter than half a wavelength of a signal transmitted and slightly shorter than half a wavelength of a signal received, the slot and the pair of dipole arms intersecting orthogonally with each other in a center of each radiation unit, the pair of dipole arms having a narrow width.

15. The antenna array of claim 14, wherein each radiator of the radiation unit is formed by etching the bottom surface of said upper substrate with a rectangular shaped pattern partially divided by each dipole arm, the dipole arms and the ground strip are formed on the same plane, and the microstrip feeder is formed parallel to the slot, on the top surface of said upper substrate between the adjacent radiators, passes over the slot, and extends to the connection means.

16. The antenna array of claim 14, wherein the microstrip feeder has an impedance stub formed in a predetermined position for controlling an inductance of the connection means.

17. The antenna array of claim 14, wherein each radiator of the radiation unit is formed by etching the bottom surface of said upper substrate with a rectangular shaped pattern, the dipole arms are formed on the top surface of said upper substrate in the center of each radiator, and the microstrip feeder is formed on the bottom surface of said upper substrate parallel to the slot between the adjacent radiators, passes over the slot and extends to the connection means.

18. The antenna array of claim 14, wherein each radiator of the radiation unit is formed by etching the bottom surface of said upper substrate with a rectangular shaped pattern partially divided by a dipole arm, smaller than the edge of the opening of the cavity, the dipole arms and the ground strip are formed on the top surface of the same plane, and the microstrip feeder is formed on the top surface of said upper substrate between the adjacent radiators, parallel to the slot, passes over the slot, and extends to the connection means.

19. The antenna array of claim 14, wherein a minimum area of the cavity opening is set by $(\lambda/2)\epsilon^{1/2}$, where '$\lambda$' indicates a wavelength of a transmitted/received signal, and '$\epsilon$' indicates a dielectric constant, and minimum values of the side lengths of the radiators are about 30% smaller than the corresponding lengths of each side of the cavity opening.

20. The antenna array of claim 14, wherein each radiator of the radiation unit is formed such that an outer edge of the radiation unit is a circle, the dipole ann is formed protruding into the radiator by a predetermined length, the dipole arm and the ground strip are formed on the same plane, the microstrip feeder is formed on the top surface of said upper substrate between the adjacent radiators, parallel to the slot, passes over the slot and extends to the connection means.

21. The antenna array of claim 14, said slot further comprising a first slot section and a second slot section.

22. The antenna array of claim 21, wherein each radiator of the radiation unit is formed by etching the bottom surface of said upper substrate with a rectangular shaped pattern partially divided by a dipole arm, the dipole arm and the ground strip are formed on the same plane, the first slot section is formed at the right and left of each dipole arm between the two radiators and the second slot section is formed parallel to the first slot section, the microstrip feeder is formed on the plane where the first and second slot sections are formed, extending from the center point between two dipole arms, parallel to the first and second slot sections, to connect to one of the dipole arms and the connection means is located between the first slot section and the radiator, and between the second slot section and the opposing radiator, to electrically connect the top surface and the bottom surface of said upper substrate.

23. The antenna array of claim 14, further comprising:

parasitic elements being formed adjacent to the dipole arms, said parasitic elements enlarging a frequency bandwidth of operation of said antenna array.

24. The antenna array of claim 23, wherein each radiator of the radiation unit is formed by etching the bottom surface of said upper substrate with a $\pi$-shaped pattern, the dipole arms and parasitic element having a different length to the dipole arms, formed at the right and left of each dipole arm, are etched, and the microstrip feeder is formed on the top surface of said upper substrate between the adjacent radiators, parallel to the slot, passes over the slot and extends to the connection means.

25. The antenna array of claim 23, wherein each radiator of the radiation unit is formed by etching the bottom surface of said upper substrate with a rectangle shaped pattern, the dipole arms are formed on the top surface of the said substrate in the center of each radiator, said parasitic elements including first and second parasitic elements having lengths different from those of the dipole arms are being formed at the right and left of each dipole arm, parallel to the dipole arm, and the microstrip feeder is formed on the top surface of said upper substrate between the adjacent radiators, parallel to the slot, passes over the slot and extends to the connection means.

26. The antenna array of claim 25, wherein the first parasitic element is formed as a single arm, and the second parasitic element is formed of two pieces divided by the microstrip feeder, and the two pieces of the second parasitic element are connected by a strap.

* * * * *